United States Patent [19]

Calhoun et al.

[11] 3,986,312

[45] Oct. 19, 1976

[54] DEMOUNTABLE WALL ASSEMBLY AND COMPONENTS THEREFOR

[76] Inventors: Ralph Calhoun, 1721 W. Behrend Drive, Phoenix, Ariz. 85027; Thorval Calhoun, 396 W. 25th, San Bernardino, Calif. 95814

[22] Filed: Oct. 5, 1973

[21] Appl. No.: 404,110

[52] U.S. Cl. ..... 52/242; 52/481; 52/DIG. 4

[51] Int. Cl.[2] ..... E04B 2/74

[58] Field of Search ..... 52/481, 483, 238, 241, 52/242, DIG. 4; 211/DIG. 1; 248/206 A; 40/142 A

[56] References Cited

UNITED STATES PATENTS

| | | | |
|---|---|---|---|
| 2,515,757 | 7/1950 | Browner | 40/142 A |
| 2,623,256 | 12/1952 | Feibelman | 248/206 A |
| 2,951,311 | 9/1960 | Luther | 52/DIG. 4 |
| 3,047,931 | 8/1962 | Boettner | 52/DIG. 4 |
| 3,086,268 | 4/1963 | Chaffin | 40/142 A |
| 3,168,787 | 2/1965 | Surrey | 40/142 A |
| 3,184,013 | 5/1965 | Pavlecka | 52/481 |
| 3,191,106 | 6/1965 | Baermann | 52/DIG. 4 |
| 3,292,328 | 12/1966 | Lewis | 52/DIG. 4 |
| 3,304,677 | 2/1967 | Paulecka | 52/481 |
| 3,305,993 | 2/1967 | Nelsson | 52/241 |
| 3,309,826 | 3/1967 | Zinn | 52/241 |
| 3,378,974 | 4/1968 | Bush | 52/483 |
| 3,460,298 | 8/1969 | Sowinski | 52/241 |
| 3,852,935 | 12/1974 | Jones | 52/238 |

FOREIGN PATENTS OR APPLICATIONS

| | | | |
|---|---|---|---|
| 1,497,554 | 10/1967 | France | 52/DIG. 4 |

*Primary Examiner*—John E. Murtagh
*Attorney, Agent, or Firm*—Sellers and Brace

[57] ABSTRACT

A demountable wall assembly utilizing uniquely formed studs of magnetic material having wide, flat flanges along the edge thereof equipped with low-height, outturned tang means therealong. The tang means cooperate with magnetized strips secured to the rear of wall plaques to hold the plaques against planar movement while the strips are held magnetically seated against the stud flanges. The studs are secured to headers crosswise of their opposite ends. A first finish strip secured to one header embraces and conceals the adjacent end edges of the plaques, and a second finish strip conceals fastener means holding the other plaque ends to the second header.

23 Claims, 4 Drawing Figures

DEMOUNTABLE WALL ASSEMBLY AND COMPONENTS THEREFOR

This invention relates to partitions and walls, and more particularly to a readily demountable wall assembly and the unique components thereof utilizing metal studs normally concealed by wall board or plaques having magnetized strips secured to their rear faces and seating against wide, flat surfaced edge flanges of the studding.

Many proposals have been made heretofore for demountable and readily changeable wall units designed for ease of assembly and disassembly and permitting changes to meet changing space requirements. However, each of these prior proposals is subject to distinct shortcomings and disadvantages avoided by the present invention. Typically, these prior proposals utilize various fastener constructions intended to facilitate detachable securement of wall paneling to the sub-structure. Attempts have been made to hold ceiling tiles or plaques to a false ceiling using permanently magnetized elements but these expedients have necessitated covering either the ceiling sub-structure or the tiles with magnetic material and attaching permanently magnetized material to the other element. This is a laborious and costly procedure avoided by this invention.

By the present invention there is provided a unique, quickly assembled and readily demountable wall component making use of standard wall covering plaques modified to a slight extent to incorporate the principles of this invention. Metal studding of magnetic material are utilized and held rigidly and properly spaced in parallel relation by cross headers at their opposite ends. These studs are formed with wide, smooth-surfaced flanges held in a common plane by the cross headers. Desirably, the flanges are provided with low-height, outturned tang means positioned to abut the lateral edges of magnetized stripping bonded or otherwise secured to the rear face of the wall panels. The tangs may be arranged in various modes such as along the opposite lateral edges of the stud flange and spaced apart double the width of the magnetized strips. Alternatively, the tangs may be struck from the body of the flange either along the remote edges thereof or to lie medially thereof and in the general plane of the stud web. This facilitates equipping the panels with elastomeric strips embedded with permanently magnetized material secured to the panels along their edges as well as along mid-points and the studs are so spaced that the longitudinal center lines of their flanges underlie the opposite lateral edges of the wall plaques. The tangs then abut the lateral edges of the magnetized strips and prevent planar displacement of the assembled plaques. A finish strip preferably extends along and embraces one end edge of the wall panels, as the upper ends. The lower ends of the plaques are preferably secured at one or two points to the lower header and a lower finish strip is secured over and conceals these fasteners.

The wall is readily disassembled for alterations, changes or otherwise, by removing the lower finish strip, withdrawing the fasteners and then peeling the individual plaques progressively away from the studding from the lower end.

Accordingly, it is a primary object of the invention to provide a unique and improved quickly assembled and readily demountable partition or walled assembly which is novel per se as well as respects the components per se.

Another object of the invention is the provision of a demountable partition utilizing magnetic studs having flat outwardly facing flanges against which magnetized strips secured to wall plaques firmly seat to hold the plaques in assembled position.

Another object of the invention is the provision of a wall unit comprising a metal stud of magnetic material having a wide, flat flange along one edge effective to hold a wall panel seated thereagainst and equipped with a magnetized strip firmly secured thereto.

Another object of the invention is the provision of a demountable wall partition having a sub-structure formed of flanged metal studs secured together by cross headers at their ends and covered along at least one face thereof by wall plaques coextensive in length with said studs and held assembled thereto by magnetized elastomeric strips bonded to the opposite longitudinal edges of said plaques.

Another object of the invention is the provision of a stud of magnetic material having uniquely designed flanges formed with low-height outturned tang means.

Another object of the invention is the provision of an improved demountable wall plaque having strips of magnetized elastomeric material secured thereto and effective to hold the same demountably assembled to magnetic studding.

Another object of the invention is the provision of wall paneling having permanently magnetized strips secured to the rear thereof and terminating short of one or both transverse ends thereof to avoid interference with channel-shaped partition headers.

These and other more specific objects will appear upon reading the following specification and claims and upon considering in connection therewith the attached drawing to which they relate.

Referring now to the drawing in which a preferred embodiment of the invention is illustrated:

Figure 1:
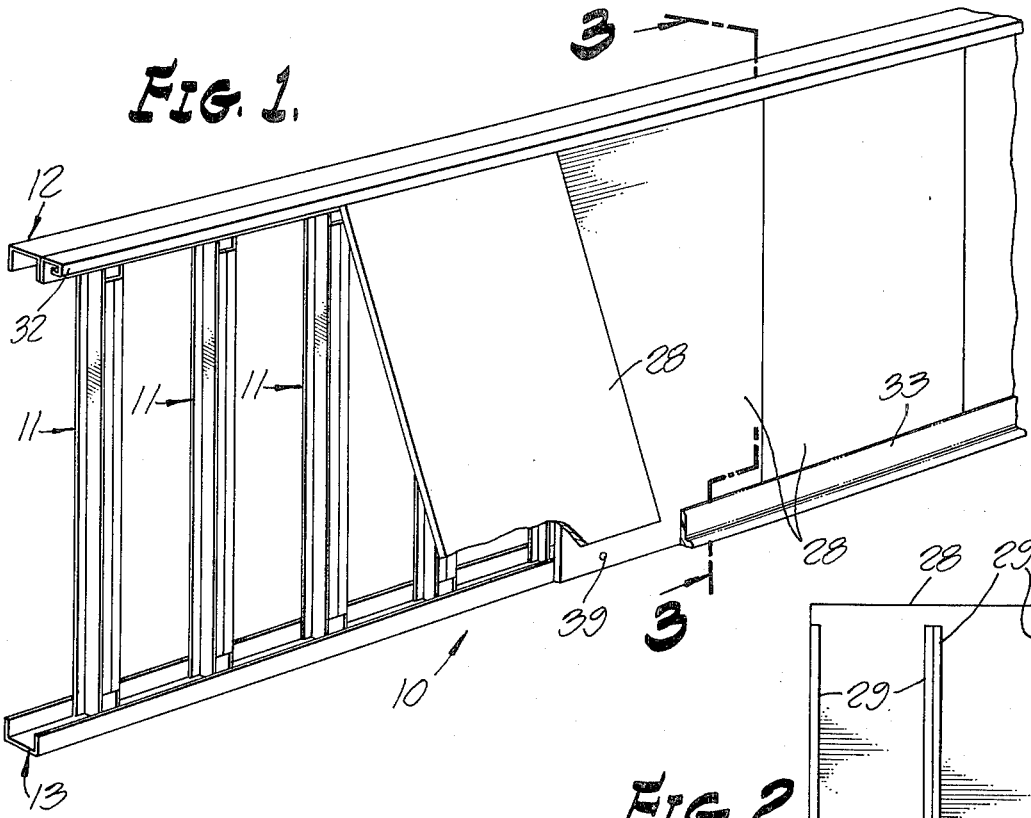
FIG. 1 is a general perspective view of a demountable partition according to this invention in the process of assembly.

Referring more particularly initially to FIG. 1, there is shown an illustrative partition assembly according to the invention, designated generally 10, comprising a plurality of metal studs 11 arranged in spaced apart parallel relation and interconnected at their opposite ends by channel-shaped headers 12,13 to which the studs are rigidly secured in any suitable manner. Usually headers 12,13 are suitably secured to the ceiling and to the floor, as by nails or ram set rivets 16,16.

Figure 4:
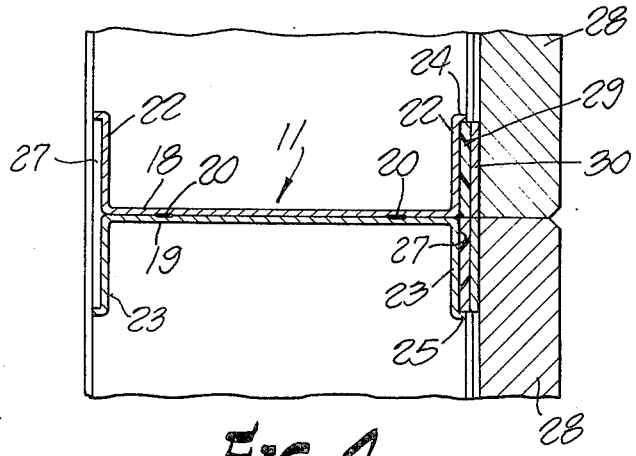
FIG. 4 is a cross-sectional view taken along line 4—4 on FIG. 3.

Studs 11 may be formed from rolled sheet magnetic metal and have the I-shaped cross-sectional configuration best shown in FIG. 4. As there shown, each stud comprises identical channel-shaped members 18,19 facing in opposite directions with their webs secured together as by spot-welding 20. The sidewalls or flanges 22,23 of members 18, 19 lie normal to the webs. These flanges are flat and smooth-surfaced for reasons which will be explained more fully presently. Flanges 22,23 include low height, outturned tang means 24,25 here shown as formed by lips along either remote edge of flanges 22,23. However, it will be understood that these tangs need not be continuous and may be struck outwardly from the surface of the flanges and could lie either along the outer edges of the flanges or in the general plane of the web portions of channels 18,19.

If the tangs comprise the outturned lip edges of flanges 22,23 then they cooperate with the bottoms of these flanges to form a shallow trough or channel 27 extending lengthwise of the outer edges of the studs 11. These outturned tangs may be continuous or relatively narrow tangs at spaced intervals along the edges of the flanges. Likewise, if the tangs are struck outwardly from near the junction of the flange with the web of the stud then they will of necessity be narrow and at spaced intervals along the stud. In either case the function of the tangs 24,25 is to abut one lateral edge of magnetized stripping to be described presently thereby to hold the same and the plaque itself against movement crosswise of the studs and the surface of flanges 22,23.

Figure 2:
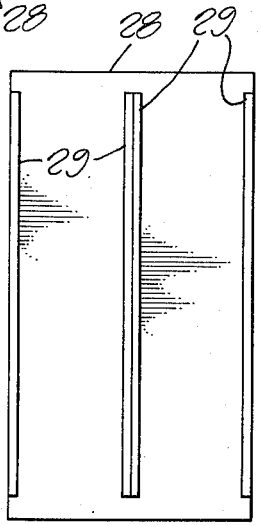
FIG. 2 is a rear plan view of one wall plaque.

Referring to FIGS. 1 and 2, there are shown plaques or panels of wall board, plaster board or the like 28 of any suitable character commonly used to provide a wall covering and a support for decorative material. These panels customarily come in standard dimensions such as 4 × 8 feet. The rear face of these panels has secured thereto in any suitable manner permanently magnetized strips 29,29. Such elastomeric stripping having permanently magnetized material embedded therein is readily available in the market and may be bonded by a suitable adhesive or otherwise secured either directly to the rear face of paneling 28 or to a strip of magnetic material 30 sandwiched between the interface of strip 29 and the rear face of panel 28. It is found that in some applications, greater holding power between stud flanges 22,23 and stripping 29 is achieved when using the magnetic layer 30. If used, strips 30 need be no wider than magnetized strips 29.

Figure 3:
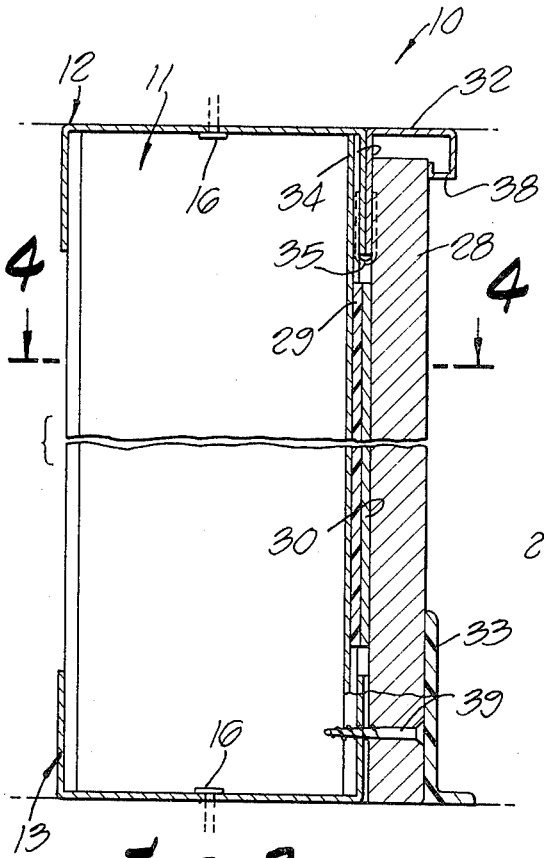
FIG. 3 is a fragmentary view on an enlarged scale taken along line 3—3 on FIG. 1 showing constructional details.

Desirably strips 29 terminate short of the opposite ends of plaques 28 by a distance somewhat greater than the depth of the side flanges of headers 12,13, as is made clear by FIG. 3, thereby avoiding any interference between the ends of strips 29 and the side flanges of headers 12,13.

Referring to FIGS. 1 and 3, it is pointed out that the partition assembly also preferably includes upper and lower finish strips or moldings 32,33. The upper strip 32 is of channel shape with one sidewall 34 having a width corresponding generally to the width of the side flange of header 12. This facilitates clipping finish strip 32 to this flange by U-shape clip 35, these spring clips being employed at spaced intervals along the length of the partition. The inturned lip 38 on the outer sidewall of finish strip 32 is sized to have a resilient and snug fitting grip with the transverse upper edge of plaques 28.

The lower finish strip 33 may be of any suitable material such as a tough plastic or extruded aluminum of a suitable material capable of withstanding abrasion and shock of the type customarily experienced by baseboards. A second function is to conceal the presence of fastener screws or the like 39 desirably but not necessarily employed to hold the bottom edges of plaques 28 pressed firmly against the base of the partition.

The mode of assembly of plaques 28 will be readily apparent from the foregoing detailed description. Customarily studding 11 is spaced so that the center webs coincide with the opposite vertical edges of plaques 28. If the plaques are of standard width, a third or intermediate stud is positioned midway between the two outer studs. The width of the magnetized strips seating channel for the studs is double the internal width of these seating channels. Customarily, a single strip of magnified material 29 is secured along either lateral edge of the plaques and a double width of the stripping is applied longitudinally of the mid-length as shown in FIG. 2.

The installation of the plaques 28 is readily apparent from FIGS. 1 and 2. The installer grasps the plaques and inserts the upper transverse edge into the channel of the upper finish strip 32, care being exercised that the opposite lateral edges of the plaque are aligned with the mid-width of a pair of studs 11. The panel is then tilted inwardly until it lies flush against the studs with strips 29 seated flush against the bottom of flanges 22 or 23. It will be understood that the height of tangs 24,25 is not in excess of the thickness of magnetized strips 29 so as not to interfere with the flush seating of strips 29 against the outwardly facing bottoms of flanges 22,23. If necessary, the plaque is shifted downwardly until its lower edge rests flush against the wall floor or flush with the bottom of lower header 13 whereby the magnetic properties of strips 29 may be utilized with maximum effectiveness to retain the plaque in place against the studding. Fasteners 29 may then be inserted following which the lower finish strip 37 is applied and secured in place in any suitable manner, as by adhesion or otherwise.

If at any later time it becomes desirable to gain access beneath any one or more plaques, it is merely necessary to detach finish strip 33 and remove one or more fasteners 39. Thereupon the panel can be detached by prying or otherwise lifting it progressively outwardly away from the studs from its lower end progressively toward its upper end whereupon the panel is withdrawn from the upper finish strip 32. Plumbing or electrical fixtures concealed by the removed panel are then rendered accessible for servicing following which the same or a new panel 28 is reinstalled in the manner described above. A damaged panel 28 is readily replaced by the same simple procedure.

It will be apparent that both sides of the interior subassembly of the partition can be similarly covered or finished or the second side may be finished in some alternate manner. The entire partition may be removed or added to the room to sub-divide it or it may be cut to a different size; likewise doors, windows and the like may be added very readily and in an obvious manner as access to the studding and headers is gained simply by detaching one or more of the wall plaques.

While the particular demountable wall assembly and components therefor herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A demountable wall assembly comprising: a plurality of spaced-apart studs formed of sheet magnetic material having a shallow relatively wide outwardly facing channel extending lengthwise of one edge thereof, a wall-forming plaque spanning said studs and having parallel strips of magnetized material secured thereto and spaced to seat within a respective one of said relatively wide stud channels with an edge of each strip closely adjacent an edge of a respective stud channel and cooperating therewith to retain said plaque against shifting crosswise of said channels, and the face of said strips seated flush against the interior bottoms of said stud channels to hold said plaque demountably assembled thereto.

2. A wall assembly as defined in claim 1 characterized in that at least one of said magnetized strips has an edge thereof closely spaced to one lateral edge of said plaque.

3. A wall assembly as defined in claim 1 characterized in that said plaque includes a pair of magnetized strips bonded along one face of said plaque with the remotely spaced edges of said strips closely adjacent a respective lateral edge of said plaque.

4. A wall assembly as defined in claim 1 characterized in that said stud channels have a width generally double the width of said magnetized strips.

5. A wall assembly as defined in claim 1 characterized in that said magnetized strips terminate at points spaced substantially from at least one end of said plaque.

6. A wall assembly as defined in claim 1 characterized in that said magnetized strips terminate at points spaced inwardly from the respective opposite ends of said plaque.

7. A wall assembly as defined in claim 1 characterized in that said plaque includes a strip of thin magnetic material interposed between one face of said plaque and each of said strips of magnetized material.

8. A demountable wall assembly comprising: a plurality of parallel studs formed from magnetic material having their opposite ends seated in and secured to a respective channel-shaped header, one edge of said studs having a wide smooth-surfaced flange lying normal to the width thereof and having low height tang means projecting outwardly therefrom, a wall plaque having a plurality of magnetized strips bonded to one face thereof and spaced to seat against said wide stud flange with its lateral edges in abutment with said tang means to retain said plaque demountably assembled to said studs and restrained from lateral planar movement crosswise of said studs.

9. A wall assembly as defined in claim 8 characterized in that said magnetized strips terminate short of but close to said channel-shaped headers.

10. A wall assembly as defined in claim 8 characterized in the provision of channel-shaped finish strip means extending crosswise of one exterior lateral end edge of said studs and having a width providing a snug seating fit for one end of said plaque, the opposite end edge of said plaque resting against the support for the adjacent one of said headers.

11. A wall assembly as defined in claim 10 characterized in the provision of removable fastener means securing said opposite end edge of said plaque against displacement outwardly away from said studs.

12. A wall assembly as defined in claim 11 characterized in the provision of a finish strip crosswise of said opposite end edge of said plaque to conceal said fastener means.

13. A wall assembly as defined in claim 8 characterized in that said tang means are located near the opposite lateral edges of said wide stud flange and spaced sufficiently to seat a pair of said magnetized strips therebetween with their remotely spaced lateral edges positioned to abut the adjacent tang means.

14. In combination, a pair of wall board plaques each having a magnetized strip secured to the rear face thereof adjacent one lateral edge thereof, a stud formed essentially of sheet magnetic material having a flange normal to the width thereof and provided with outturned tangs spaced apart a distance sufficient to seat against the remotely spaced lateral edges of said magnetized strips when the edges of said plaques are abutted together with the exposed face of said strips lying flush against the portion of said stud flange between said outturned tangs thereby to hold said plaques demountably assembled to said stud and restrained from movement crosswise of said stud in the plane of said plaques.

15. The combination defined in claim 14 characterized in that said stud flange is smooth surfaced and planar to provide continuous surface to surface contact with the juxtaposed surfaces of said magnetized strips.

16. The combination defined in claim 14 characterized in that said strips terminate short of the opposite ends of said plaques.

17. The combination defined in claim 16 characterized in the provision of separate channel shaped headers seated over and secured to the opposite ends of said stud with its web portion lying normal to the length of said stud.

18. A partition assembly comprising: a plurality of studs formed essentially of sheet magnetic material arranged parallel to one another in spaced-apart relation by rigid headers secured to the opposite ends thereof, at least some of said studs having wide planar flanges lying in a common plane along one face of said partition and provided with low height spaced apart outwardly projecting tangs, and plaques mounted over said one partition face and held detachably assembled thereto by magnetized strips secured to the rear of said plaques in position for the exposed face of said strips to seat against said planar stud flanges in areas between said tangs and with one edge of said strips adjacent the face of said tangs to restrain said plaques against planar movement crosswise of said studs.

19. A partition assembly as defined in claim 18 characterized in that said plaque edges abut one another and in that certain of said magnetized strips are secured to the rear of said plaques closely adjacent said abutting edges with edges of adjacent ones of said strips positioned against the tangs of one of said studs and cooperating therewith to prevent movement of said plaques crosswise of said studs in the plane of said plaques.

20. A partition assembly as defined in claim 18 characterized in the provision of finish strip means secured opposite the outer edge of one of said headers and shaped to snugly embrace the adjacent end edges of said plaques.

21. A demountable building wall assembly comprising: a plurality of ferrous metal studs having a pair of wide flanges lying parallel to one another and interconnected by a web integral with said flanges and lying in a plane generally normal to the plane of at least one of said flanges, means rigidly interconnecting adjacent ones of said studs with the flanges along one lateral edge thereof lying in a common plane, and at least one wall-forming plaque spanning said studs and held demountably assembled thereto by strips of permanently magnetized material secured to said plaque in position to lie flush against the exterior surface of said stud flanges and cooperating therewith to hold said plaque firmly in place thereagainst.

22. A wall assembly as defined in claim 21 characterized in that said plaque comprises plasterboard having strips of permanently magnetized material secured thereto parallel to the opposite lateral edges thereof and spaced apart sufficiently to seat flush against the flanges of a respective one of a pair of said ferrous metal studs.

23. A wall assembly as defined in claim 22 characterized in that said plasterboard plaque and said studs are generally coextensive in length and span the distance between the floor and ceiling of a conventional size inhabitable room.

* * * * *